US005588391A

United States Patent [19]

Tessandier

[11] Patent Number: 5,588,391

[45] Date of Patent: Dec. 31, 1996

[54] FIN WITH TRAILING EDGE FIXED FLAPS FOR SHIPS

[75] Inventor: Alain Tessandier, Le Havre, France

[73] Assignee: Societe Nouvelle des Ateliers et Chantiers du Harve, Le Havre, France

[21] Appl. No.: 443,404

[22] Filed: May 17, 1995

[30] Foreign Application Priority Data

Dec. 29, 1994 [FR] France ..... 94 15881

[51] Int. Cl.[6] ..... B63B 1/22

[52] U.S. Cl. ..... 114/284; 114/122; 114/164

[58] Field of Search ..... 114/271, 272, 114/273, 274, 285, 286, 289, 122, 126, 127, 162, 164, 140, 141, 142; 244/198, 199, 212, 213, 215, 130

[56] References Cited

U.S. PATENT DOCUMENTS 1,661,114 2/1928 Flettner .
2,142,123 1/1939 Fahrney ..... 244/212
4,172,574 10/1979 Spillman ..... 114/272

FOREIGN PATENT DOCUMENTS 9100048 8/1992 Netherlands .
174019 2/1922 United Kingdom .
9212046 7/1992 WIPO .

OTHER PUBLICATIONS

Marine Engineers Review, "Using the Rudders as Stabilizers", p. 32, Aug. 1992.

*Primary Examiner*—Jesus D. Sotelo
*Attorney, Agent, or Firm*—Browdy and Neimark

[57] ABSTRACT

A fin with trailing edge fixed flaps for ships, characterized in that it is made of a main fin (1) to which are associated one or several pairs of fixed flaps (2*a* and 2*b*) of mean camber.

12 Claims, 4 Drawing Sheets

FIN WITH TRAILING EDGE FIXED FLAPS FOR SHIPS

FIELD OF THE INVENTION

Presently known ship anti-rolling stabilizers with collapsible fins or not are provided with fins the structure of which can be simple (single fin) or complex (camber flaps articulated on a simple main fin).

BACKGROUND AND OBJECT OF THE INVENTION

Various types of simple usual profiles are already used.

The effort perpendicular to the fin plane which produces the stabilizing effect is characterized by a coefficient of lift usually called Cz.

This effort is expressed by the formula:

$$L=\frac{1}{2}\rho Cz\ S\ V^2$$

where

ρis the density of the ambient medium

S the surface of the fin

V the displacement speed of the profile in the ambient medium (generally the speed of the ship provided with the stabilizers) (see FIG. 1)

The Cz coefficient varies according to FIG. 2 as a function of the inclination of the fin in the water streams. The Zo portion of the curve corresponds to the stalling zone corresponding to a loss of lift.

So, one sees that for a given effort and a given speed, the surface of the fin will be all the smaller that the Cz will be higher.

Yet, the surfaces of the fins determine their weight and therefore the stabilizers prices. Moreover, when the fins are collapsible, they determine what is called an additional floatability loss, meaning the water volumes of the hull housings in which the fins are stored when the weather is good.

All these technical and cost elements are taken in account in the performances and in the price of the ship which they fit out.

Therefore, the ship builders have done their best to use profiles having Cz's as high as possible. In the ascending order of the Cz's, one finds:

Standard simple profiles having the advantage of a simple structure and a simple fin control mechanism. The resistance to progression in water is small, but the effect of the small Cz is that this fin type is generally only used for fins of small surfaces. An example of a profile of this type is shown in FIGS. 1 and 3.

A "fish" type profile to which can be added a plate at the end of the fin. This profile improves the Cz but has the disadvantage of generating noises and vibrations. In addition, the resistance to progression is increased. One example of a profile of this type is shown in FIG. 4.

A profile with camber flap. In this case, it is a profile including a main fin at the trailing edge of which is articulated a camber flap. The articulation is such that to any angle α of the main fin corresponds an angle β of the flap.

The articulation of the flap on the main fin is provided by any known mechanisms (pinions, connecting rods, etc.). The Cz is improved but the installation is complex and costly since the articulation is continuously immersed in sea water. In some cases, this articulation can form a limit for the fin surface since the deformations of the fin in operation and due to the deflection can be incompatible with such an articulation. In addition, the resistance to progression is high and can have a brutal stalling characteristic, in the same way as with the "fish" type profile. An example of this type of profile is shown in FIG. 5.

The effect of this invention is to increase the Cz to a value which is substantially higher than that of a profile with a camber flap, while preserving a simple structure and a resistance to progression which is less or at most equal to that of a "fish" type profile or of a camber flap, and this whatever the fin span/mean chord utilization ratio.

SUMMARY OF THE INVENTION

According to the invention, the stabilizing device is made of a main fin to which are associated one or several pairs of fixed flaps having a mean camber.

According to other features of the invention:

- the pairs of fixed flaps are placed symmetrically on the lower and upper faces of the main fin to which they are fixedly connected;
- the pairs of flaps respectively situated on the lower and upper sides of the main fin are placed near the trailing edge of said main fin so that the tangents to their mean camber at the leading edge, or inclined, are substantially parallel to the mean plane of the main fin; yet dispositions other than tangent at the leading edge parallel to the fin plane can also be envisaged (inclined tangents) as a function of the performances;
- the main fin is provided at its ends with plane plates to which are fixed the ends of the pairs of fixed flaps;
- the connection of the pairs of flaps with the main fin is obtained by means of plates to which struts can be associated;
- the assembly formed by the main fin, the flaps, the plates and the struts constitutes the stabilizing fin as such and this fin is inclined with respect to the water streams by any known means with the assistance of an axis; yet, the fin can be used as a fixed plane and not be orientable, which is the case of passive stabilizing planes or damping devices;
- the devices is implemented for known roll stabilizers of the collapsible or non collapsible type. The fin can be used for anti-pitch dispositions, anti-roll devices, steering apparatus, submarine diving bars, and any ship steering or stabilizing device. This type of fin can also Be used on any civil (mono-hull, multi-hull, swath, wave pearcer), pleasure or war ship.

Various other features of the invention will become more apparent from the following detailed description.

BRIEF DESCRIPTION OF THE DRAWINGS

Embodiments of the object of the invention are shown by way of non limiting examples in the accompanying drawings.

DETAILED DESCRIPTION OF A PREFERRED EMBODIMENT

Figure 1:
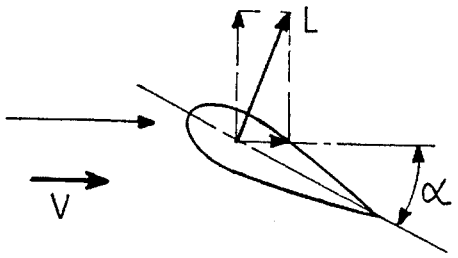
FIG. 1 (PRIOR ART)
FIG. 1 is a schematic illustration of a simple fin.
Figure 2:
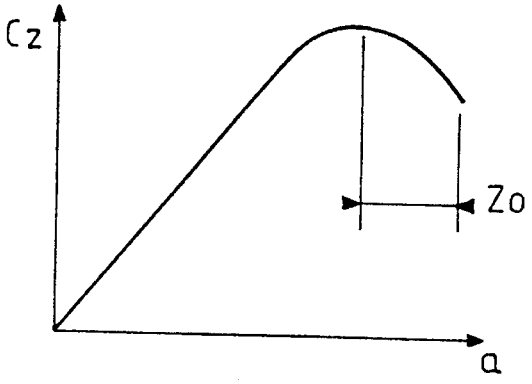
FIG. 2 is a curve showing the action of the fin of FIG. 1.
Figure 3:
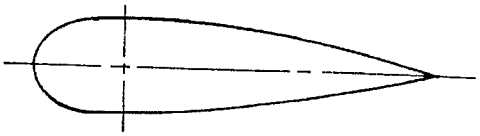
FIG. 3 (PRIOR ART)
FIG. 3 is a cross-sectional view of the simple fin of FIG. 1.
Figure 3A:
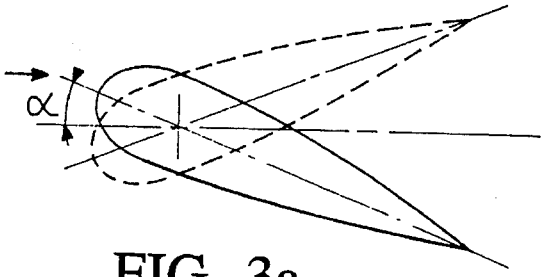
FIG. 3a (PRIOR ART)
FIG. 3*a* is a sectional view showing the direction of the water streams for various positions of the fin of FIG. 1.
Figure 4:
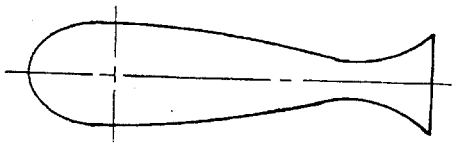
FIG. 4 (PRIOR ART)
FIG. 4 is a sectional view of a so-called "fish" type fin.
Figure 4A:
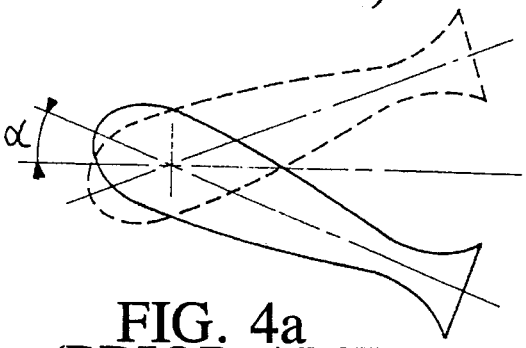
FIG. 4a (PRIOR ART)
FIG. 4*a* is a sectional view showing the direction of the water streams for various positions of the fin of FIG. 4.
Figure 5:
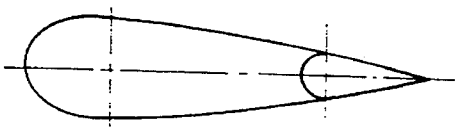
FIG. 5 (PRIOR ART)
FIG. 5 is a cross-sectional view showing a so-called fin with camber flap.
Figure 5A:
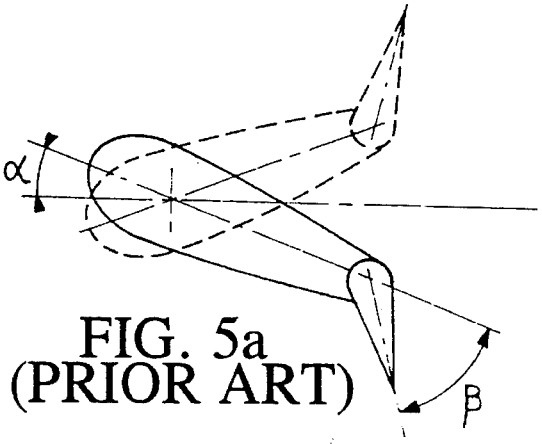
FIG. 5a (PRIOR ART)
FIG. 5*a* is a sectional view showing the direction of the water streams for various positions of the fin of FIG. 5.

In the embodiment of FIG. 1, the fin profile has a relatively flat stalling characteristic which allows absorbing without difficulties the disturbances in the direction of the water streams due to the residual movement of the ship and the orbital speed of the swell. Examples of this type of profile are shown in FIGS. 6, 7, 9 and 10 which show flaps of a shape generally known.

Figure 6:
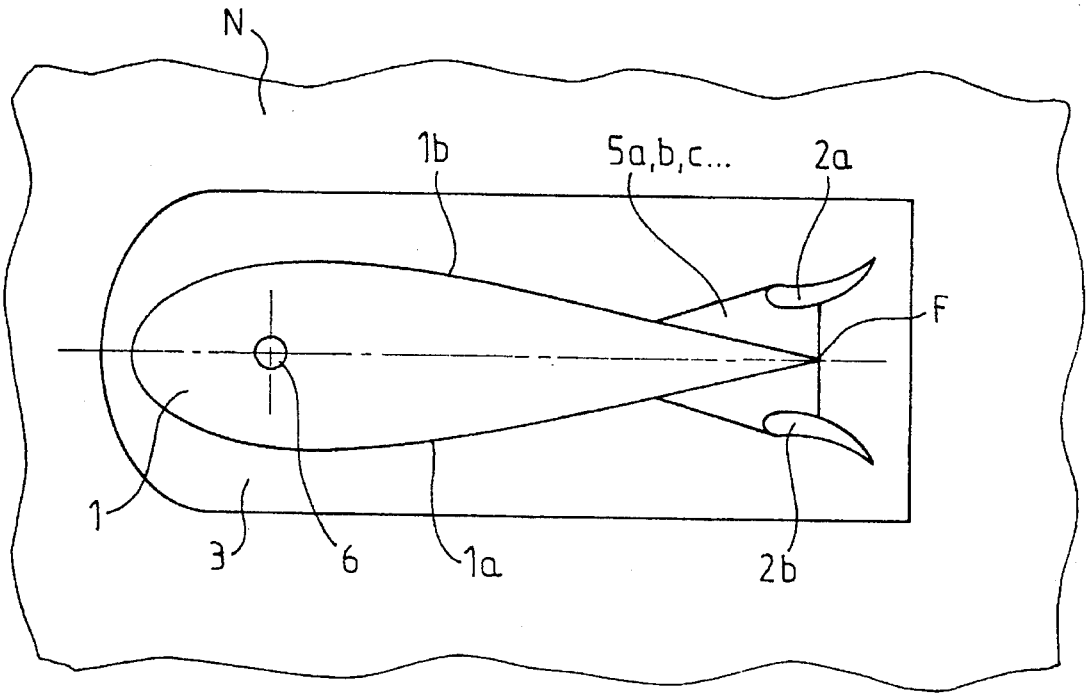
FIG. 6 is a schematic sectional view of a complex fin according to the invention.
Figure 6A:
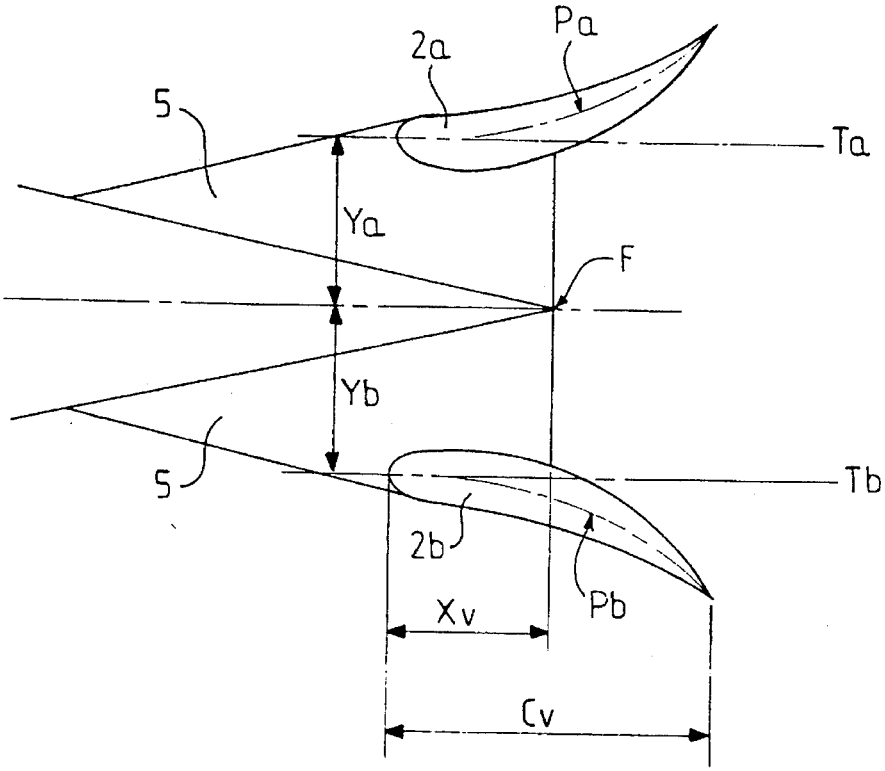
FIG. 6*a* is a schematic view corresponding to FIG. 6 and showing various hydrodynamic characteristics.

In this case, the main fin 1 (FIG. 6) has a known symmetrical standard profile to which are associated one or several pairs of flaps 2*a* and 2*b* with camber profiles which are fixed with respect to the main fin and are situated in the vicinity of the trailing edge F of the main fin, respectively on the lower side 1 and upper side 1*b* of the main fin, the cambers of the flaps being opposite and symmetrical. For the sake of commodity, a profile example including a single pair of flaps 2*a*, 2*b* is shown in FIGS. 6 and 6*a*.

The flaps 2*a* and 2*b* are placed in such manner that the tangents at the leading edge Ta and Tb to their mean profile Pa and Pb are parallel to the mean plane of the main fin, although other dispositions such as oblique tangents can also be envisaged.

The camber Pa, Pb of the flaps, their distance Xv, Ya, Yb to the main fin and the chord Cv can be adjusted as a function of the displacement speed characteristics of the profile in the ambient medium, of the mean immersion of the profile in this medium and of the acceptable or predictable progression resistances. The main fin and the flaps can also be made of known or not standard profiles, symmetrical or not. The flaps can also be without mean camber.

Figure 9:
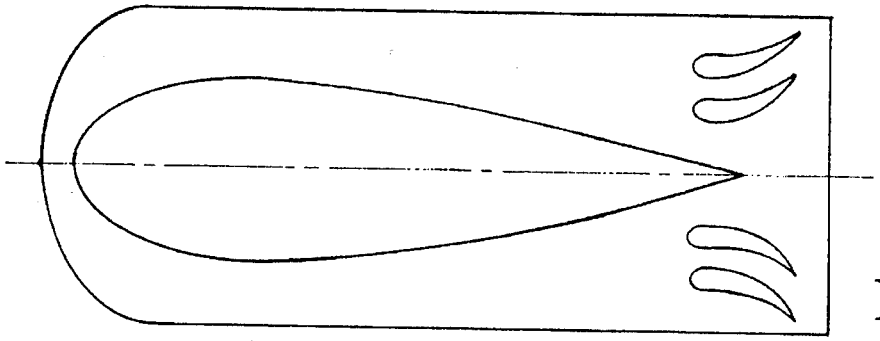
FIG. 9 is a schematic side elevation view of a variant of the fin according to the invention.
Figure 10:
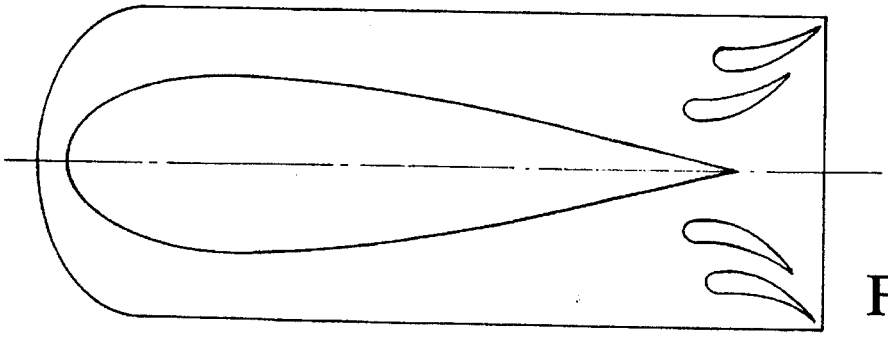
FIG. 10 is a schematic side elevation view of another variant of the fin according to the invention.

In the case of several pairs of flaps, they can be placed in a symmetrical fashion with respect to the mean plane of the main fin, but they can also be offset or not in the direction of the profile of the main fin, as shown in FIGS. 9 and 10.

The main fin 1 is provided at its ends (that is the side opposite the ship N) with a plate 3 which limits the circulation of the ambient fluid between the lower surface and the upper surface 1*b*.

Figure 7:
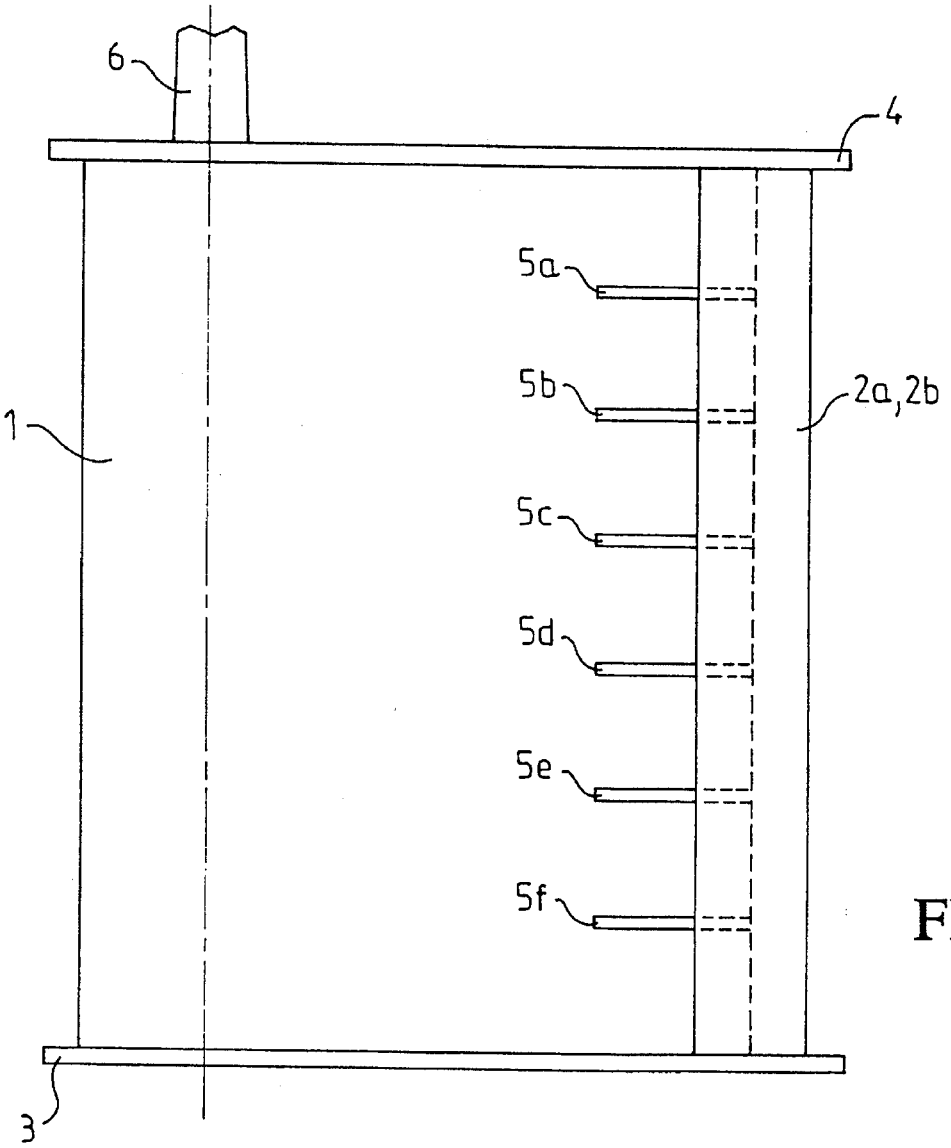
FIG. 7 is a schematic plan view of a fin according to the invention.
Figure 8:
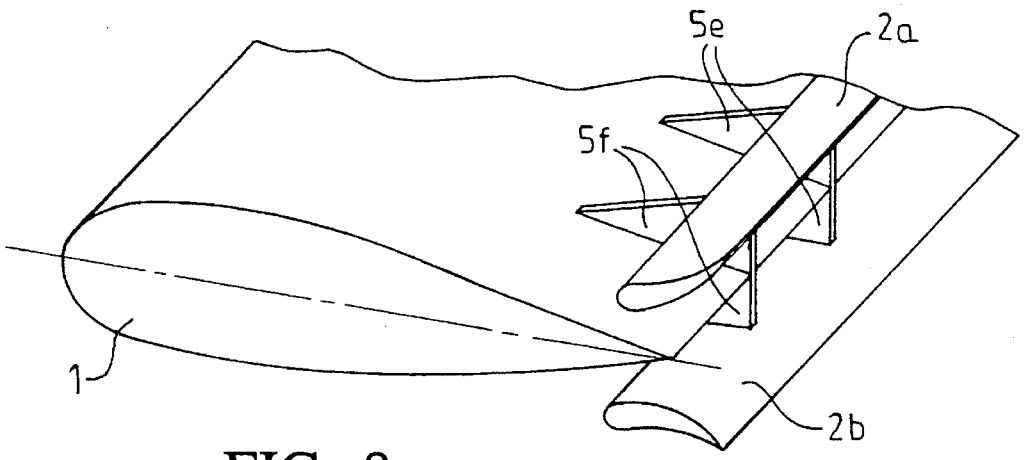
FIG. 8 is a partial perspective view of the fin of FIG. 7, showing particular characteristics.

The flaps 2*a* and 2*b* (or the pairs of flaps) are connected in FIG. 7 to the main fin 1 on the one hand via plates 3 and 4 at the end of the main fin and, on the other hand, via struts 5*a*, 5*b*, 5*c*, . . . , 5*f* placed along the profiles 1, 2*a* and 2*b*. This connection can be provided by any known means (welding, screwing . . . ). According to the dimensions of the fin, the struts 5*a*, 5*b*, 5*c*, . . . 5*f* struts 5*a*, 5*b*, 5*c* . . . can be omitted.

An axis keyed onto the main fin 1 drives in rotation the main fin 1 with its pair or pairs of flaps 2*a* and 2*b* and the plates 3 and 4. This assembly is equivalent to a simple fin.

Figure 11:
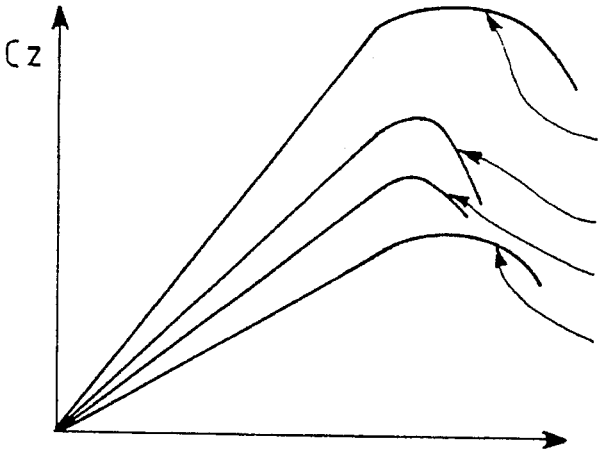
FIG. 11 shows a set of comparative curves.

The compared performances of the various cited profiles are the following:

One sees on the diagram of FIG. 11 the interest of this type of profile with respect to the weights, the loss of additional lift, the simplicity and the cost.

The described fin with fixed flaps can be implemented in all steering and stabilizing devices of the movements of a ship and generally speaking in any surface and any assembly collapsible or not, and this whatever the fin span/mean chord ratio. Thus, the fin is convenient for any passive, active or semi-active system or assembly (steering, drift, etc. stabilizing plane), collapsible or not.

What is claimed is:

1. A fin with trailing edge fixed flaps for ships comprising a main fin to which is operatively associated at least one pair of fixed flaps of mean camber, said fixed flaps being located near a trailing edge of said main fin and placed symmetrically on a lower face and an upper face of said main fin, said main fin being equipped with end plane plates and struts on which are fixedly connected said at least one pair of fixed flaps, wherein said at least one pair of flaps is placed so that tangents to said mean camber at said leading edge are parallel to a mean plane of said main fin.

2. An integral fin unit for ships comprising a plurality of parts all fixed relative to one another so that all said parts move as a unit and not relative to one another, said parts comprising a main fin to which is operatively associated at least one pair of fixed flaps of mean camber, said fixed flaps being located near a trailing edge of said main fin and placed symmetrically on a lower face and an upper face of said main fin, said main fin being equipped with end plane plates and struts on which are fixedly connected said at least one pair of fixed flaps.

3. The integral fin for ships as set forth in claim 2, wherein said at least one pair of flaps is placed so that tangents to said mean camber at said leading edge, are oblique with respect to a mean plane of said main fin.

4. The integral fin for ships as set forth in claim 2, wherein an assembly formed by said main fin, fixed flaps, end plane plates and struts forms a stabilizing fin for said ship, and in that said stabilizing fin is provided with an axis to be inclined with respect to water streams.

5. The integral fin for ships as set forth in claim 4, which is implemented as a fin anti-roll stabilizer for said ship.

6. The integral fin for ships as set forth in claim 4, which is implemented as a fin anti-pitch stabilizer for said ship.

7. The integral fin for ships as set forth in claim 4, which is implemented as a steering gear for said ship.

8. The integral fin for ships as set forth in claim 4, which is implemented as a depth control rudder for said ship.

9. The integral fin for ships as set forth in claim 2, which is implemented as a steering gear for said ship.

10. A fin with trailing edge fixed flaps for ships comprising a main fin to which is operatively associated at least one pair of fixed flaps of mean camber, said fixed flaps being located near a trailing edge of said main fin and placed symmetrically on a lower face and an upper face of said main fin, said main fin being equipped with end plane plates and struts on which are fixedly connected said at least one pair of fixed flaps, said fin being implemented as a fin anti-roll stabilizer for said ship.

11. A fin with trailing edge fixed flaps for ships comprising a main fin to which is operatively associated at least one pair of fixed flaps of mean camber, said fixed flaps being located near a trailing edge of said main fin and placed symmetrically on a lower face and an upper face of said main fin, said main fin being equipped with end plane plates and struts on which are fixedly connected said at least one pair of fixed flaps, said fin being implemented as a fin anti-pitching stabilizer for said ship.

12. A fin with trailing edge fixed flaps for ships comprising a main fin to which is operatively associated at least one pair of fixed flaps of mean camber, said fixed flaps being located near a trailing edge of said main fin and placed symmetrically on a lower face and an upper face of said main fin, said main fin being equipped with end plane plates and struts on which are fixedly connected said at least one pair of fixed flaps, said fin being implemented as a depth control rudder for said ship.

* * * * *

UNITED STATES PATENT AND TRADEMARK OFFICE

CERTIFICATE OF CORRECTION

PATENT NO. : 5,588,391

DATED : 12/31/96

INVENTOR(S) : ALAIN TESSANDIER

It is certified that error appears in the above-indentified patent and that said Letters Patent is hereby corrected as shown below:

Cover page, Item [73], delete "Harve" and insert therefor --Havre--.

Signed and Sealed this

Twentieth Day of May, 1997

Bruce Lehman

*Attest:*

BRUCE LEHMAN

*Attesting Officer*

*Commissioner of Patents and Trademarks*